US011174074B2

(12) United States Patent
Safarik

(10) Patent No.: US 11,174,074 B2
(45) Date of Patent: Nov. 16, 2021

(54) MULTI-COMPARTMENT PACKAGE FOR CONSUMABLE PRODUCTS, AND METHOD FOR CONFIGURING AND USING SUCH A PACKAGE

(75) Inventor: Kristy Safarik, Chicago, IL (US)

(73) Assignee: WM. WRIGLEY JR. COMPANY, Chicago, IL (US)

( * ) Notice: Subject to any disclaimer, the term of this patent is extended or adjusted under 35 U.S.C. 154(b) by 0 days.

(21) Appl. No.: 13/884,644

(22) PCT Filed: Nov. 11, 2011

(86) PCT No.: PCT/US2011/060327

§ 371 (c)(1),
(2), (4) Date: May 10, 2013

(87) PCT Pub. No.: WO2012/065040

PCT Pub. Date: May 18, 2012

(65) Prior Publication Data

US 2013/0233859 A1 Sep. 12, 2013

Related U.S. Application Data

(60) Provisional application No. 61/413,123, filed on Nov. 12, 2010.

(51) Int. Cl.
*B65D 25/00* (2006.01)
*B65D 83/04* (2006.01)
(Continued)

(52) U.S. Cl.
CPC ..... *B65D 25/00* (2013.01); *B65D 5/5495* (2013.01); *B65D 83/0463* (2013.01); *B65D 85/60* (2013.01)

(58) Field of Classification Search
CPC ..... B65D 25/00; B65D 85/00; B65D 5/4229; B65D 75/327; B65D 77/0413; B65D 85/60; B65D 83/0463; B31B 1/14
(Continued)

(56) References Cited

U.S. PATENT DOCUMENTS 3,979,041 A 8/1976 DuRoss
4,294,353 A * 10/1981 Focke et al. ..... 206/273
(Continued)

FOREIGN PATENT DOCUMENTS

WO WO2008153953 A1 12/2008
WO WO 2009101524 A2 * 8/2009
WO 2009151504 A1 12/2009

OTHER PUBLICATIONS

Extended European Search Report in EP Application No. 11840273.4 dated Feb. 23, 2017, 7 pages.

*Primary Examiner* — Anthony D Stashick
*Assistant Examiner* — James M Van Buskirk

(57) ABSTRACT

A package (10) for storing and dispensing a consumable product (24, 34) includes a first compartment (20) and a second compartment (30) that are hingedly and detachably attached by a first connection member (40) such as a perforated hinge, and a second connection member (52, 54, 56) that is removably attached to the compartments (20, 30). In a preferred embodiment, the second connection member includes a tear-strip (52) with one or more lines of weakness (58, 62). A related method for configuring and using such a package is also described.

10 Claims, 4 Drawing Sheets

(51) Int. Cl.
*B65D 5/54* (2006.01)
*B65D 85/60* (2006.01)

(58) Field of Classification Search
USPC ..... 206/538; 220/506, 520; 493/56
See application file for complete search history.

(56) References Cited

U.S. PATENT DOCUMENTS

| | | | | |
|---|---|---|---|---|
| 4,838,424 | A * | 6/1989 | Petzelt | 206/459.5 |
| 4,932,534 | A * | 6/1990 | Focke | B65D 5/5495 206/273 |
| 5,206,042 | A | 4/1993 | Dave et al. | |
| 7,159,717 | B2 * | 1/2007 | Aldridge et al. | 206/449 |
| 7,469,816 | B2 * | 12/2008 | Rosenkranz | B65D 27/06 229/303 |
| 7,527,189 | B2 | 5/2009 | Billig et al. | |
| 8,640,874 | B2 * | 2/2014 | Shin | A61J 1/035 206/539 |
| 2005/0269233 | A1 * | 12/2005 | Aldridge | 206/472 |
| 2007/0048414 | A1 * | 3/2007 | Glydon | B65D 5/38 426/120 |
| 2008/0053863 | A1 | 3/2008 | Glydon | |
| 2011/0017632 | A1 | 1/2011 | Lee et al. | |
| 2011/0180444 | A1 * | 7/2011 | Mezzini | 206/461 |

* cited by examiner

MULTI-COMPARTMENT PACKAGE FOR CONSUMABLE PRODUCTS, AND METHOD FOR CONFIGURING AND USING SUCH A PACKAGE

PRIORITY DATA

The present patent application is a 371 of international application Ser No. PCT/US11/60327 filed Nov. 11, 2011, which claims benefit from U.S. Ser. No. 61/413,123 filed Nov. 12, 2010, and incorporates by reference from the above-identified applications as if they are entirely restated herein

BACKGROUND OF THE INVENTION

The present invention is directed to product packaging More particularly, the present invention is directed to a multi-compartment package for a consumable product, as well as to a related method for configuring and using such a package, especially as relating to a package for gum or other confectionery products Packaging of confectionery products and other consumable products is important for marketing and display of the products It is desirable to present an attractive and distinctive package with space for brand names, graphics and text, while at the same time being fully functional and appealable to the consumer for carrying. Packaging must also serve practical needs such as keeping the products from being damaged during shipping, keeping the products fresh, and in some cases providing a reusable and reclosable container, for example, when not all of the products are likely to be consumed at one time.

It is also desirable to provide a package that is convenient for use as a portable package and that may be reconfigured by the consumer into a different and more convenient format, shape or size, so that, for example, the package will fit conveniently in a pocket or purse Further, it is desirable that the package can be reduced in size after part of the product has been consumed It is also desirable to have a package that can reduce in size if the consumer wants to take only a portion of the package with them, for various events or for general consumer convenience It is also desirable to provide an attractive package which in its initial configuration has a relatively large "footprint" for display purposes, to catch the eye of consumers and to provide generous space for branding, graphics, other indicia and textual information It is further desirable that the package remain neat and attractive after having been opened and reconfigured by the consumer

SUMMARY OF THE INVENTION

In accordance with the present invention, reconfigurable packages are provided for storing and dispensing consumable products, particularly confectionery products such as candy or gum The package is particularly well-suited for use as a portable package The portability of the package is enhanced by its ability to be reconfigured Methods of making the package and methods of reconfiguring the package are also provided in accordance with other aspects of the invention A reconfigurable package is further disclosed in PCT/US09/02296 entitled "RECONFIGURABLE PACKAGE FOR CONFECTIONERY PRODUCTS", the disclosure of which is fully incorporated herein by reference In accordance with one aspect of the present invention, a package for storing and dispensing a consumable product is provided. The package is particularly suited for storing confectionery products, such as for example, chewing gum In one embodiment, the package for storing and dispensing a consumable product comprises a first compartment sized to receive a quantity of consumable product, a second compartment hingedly and detachably secured to the first compartment, where the second compartment is sized to receive a quantity of consumable product.

The package may further include a connection member that may extend from one compartment to the other compartment to further secure the compartments to one another The connection member may be in the form of a tear strip that is includes at least one severable line of weakening such that the tear strip can be removed to expose the confectionary product, such as a blister pack Moreover, the package may further include at least one severable line of weakening between the first and second compartments such that the first and second compartments may be separated from one another if desired The lines of weakening can be any suitable line of weakening, including but not limited to a perforated line or a score line.

The package may comprise a quantity of consumable product contained in each of the first and second compartments. Such as for example, but not limited to, chewing gum or other confections. More particularly, including but not limited to, chewing gum or other confections in multiple forms, such as for example, stick form, tab form, pellet form, chunk form, or any other desirable form that may be enclosed within a compartment Any desired type of product can be contained in the first and second compartments The product may also be contained within a blister pack or any other type of internal package (i.e, wrapping) The blister pack may be composed of two separate blister packages, one located in each of the first and second compartments In accordance with another aspect of the invention, the package for storing and dispensing a consumable product is provided. The package includes a first compartment sized to receive a quantity of consumable product and a second compartment hingedly secured to the first compartment, the second compartment sized to receive a quantity of consumable product The package is reconfigurable from one configuration to an alternate configuration by movement of the first and second compartments about the hinge such that the compartments are folded upon one another to form a more compact, smaller profile or "footprint" of the package As suggested, in one configuration, the first and second compartments are disposed in substantially parallel planes In accordance with another aspect of the invention, any of the previously described packages may further include an overwrapper to further maintain the package in the initially planar configuration, as well as provide for further branding and marketing opportunities.

In accordance with another aspect of the invention, a method of reconfiguring a package for storing and dispensing a consumable product is provided. The method includes providing a package, of any of the types previously described The method further includes reconfiguring the package from one configuration by moving the first and second compartments relative to each other about the hinge and thereafter placing the package into alternate configurations The method may further include reconfiguring the package by causing the connection member coupling the first and second compartment to break along the line of weakness provided by the connection member Moreover, a line of weakening between the two compartments further allows for the relative movement of the first and second compartments about the hinge The hinge may then further be comprised of a line of weakness and such line can be broken, resulting in two separate compartments, as shown throughout the Figures herein representing preferred embodiments of the disclosed invention.

In accordance with another aspect of the invention, a blank for making the package is provided as shown in the attached Figures The preferred blank as shown is folded to obtain the package having the multi compartments and the integrated connection member In accordance with another aspect of the invention, a method of opening a package for storing and dispensing a consumable product is provided. The method includes providing a package comprising at least two compartments sized to receive a quantity of a consumable product In particular, a first compartment is sized to receive a first quantity of a consumable product, and a second compartment is sized to receive a second quantity of consumable product The first and the second compartments are hingedly secured to one another. The package may further include a connection member that extends from one compartment to another to secure the compartments to one another The connection member preferably includes a tear strip having a tab for ease of removal of the tear strip The package is reconfigurable from the initial configuration to another configuration by removal of the tear strip and the relative movement of the second compartment away from the first compartment about the hinge

DETAILED DESCRIPTION OF THE PREFERRED EMBODIMENTS

Figure 1:
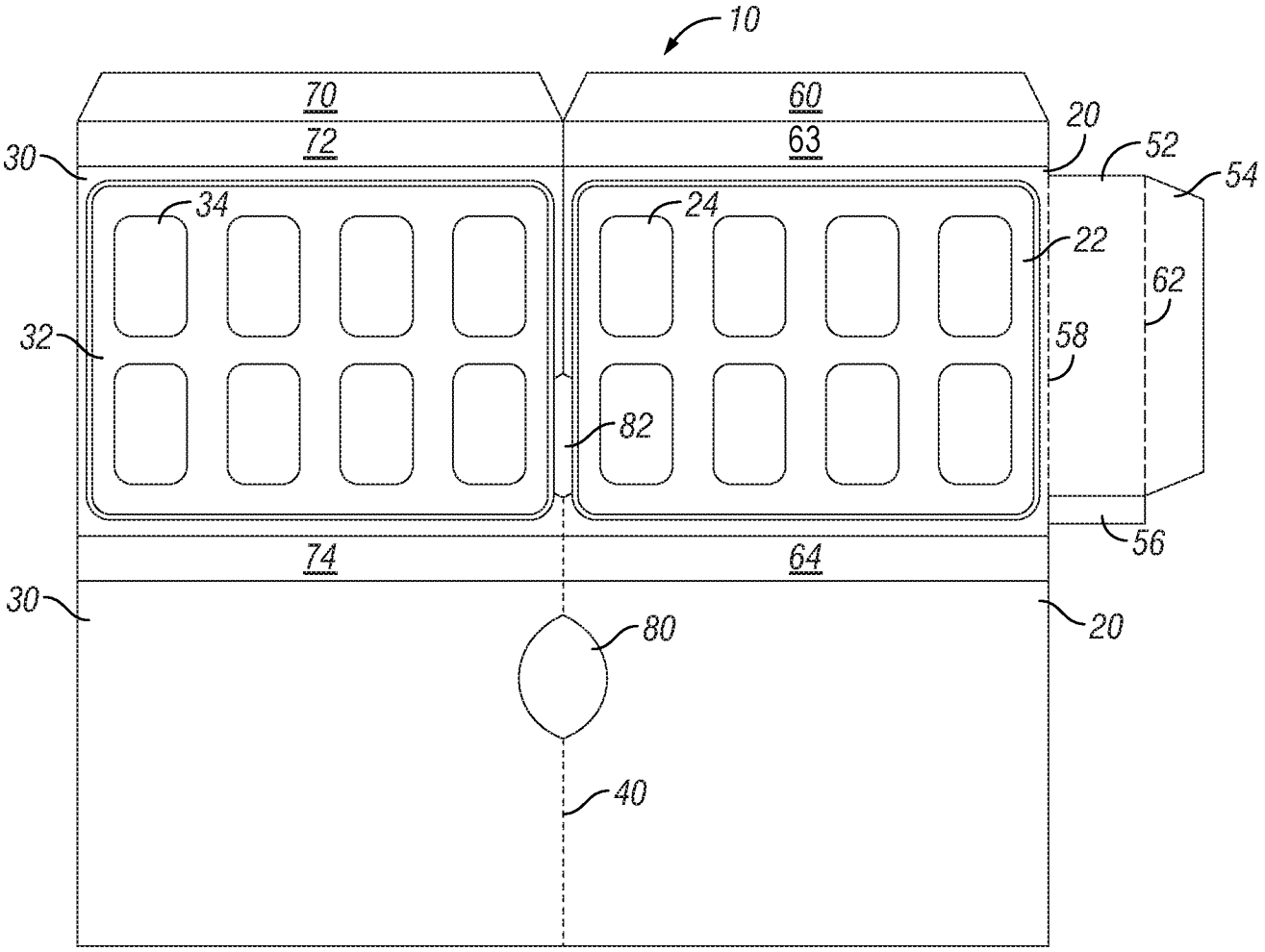
FIG. 1 depicts an unassembled multi-compartment package for a consumable product, in accordance with a preferred embodiment of the present invention

The features of a preferred embodiment of the present invention are described with reference to FIGS. 1-7, as follows Referring to FIG. 1, a package 10 for storing and dispensing a consumable product (such as a confectionery or a chewing gum) includes a first compartment 20, a second compartment 30, a first connection member 40, and second connection members 52, 54, 56 First compartment 20 and second compartment 30 are each sized to receive quantities of consumable product, such as confectionery or gum products (individual pieces of which are depicted by reference numbers 24, 34) that are, for example, contained with blister packages 22, 32

As depicted in FIG. 1, first compartment 20 and second compartment 30 are hingedly and detachably attached by way of a first connection member 40, which is impressed into the material that forms package 10 First connection member 40 is designed to permit separation of first compartment 20 from second compartment 30 upon application of an appropriate tearing force by a user First connection member 40 is preferably realized as a perforation, but is capable of being realized by alternative means, such as by a scoreline or by other suitable means that are known to those skilled in packaging and related arts Second connection member 52, 54, 56 is coupled to first compartment 20 and second compartment 30, and serves (in cooperation with first connection member 40) to further connect compartments 20, 30 to each other Second connection members 52, 54, 56 are removably attached to the compartments 20, 30 by at least one or more lines of weakening 58, 62 which, during disassembly of package 10, allow a user to separate first compartment 20 from second compartment 30

Preferably, as described in FIG. 1, second connection member 52, 54, 56 is configured to include a tear strip 52, a flap 54, a tab 56, and two lines of weakening 58, 62. Flap 54 is illustrated in FIG. 1 as having angled edges, but may also be realized with rounded edges (not explicitly depicted in the Figures). First and second lines of weakening 58, 62 are preferably realized as perforations or scorelines (having any of a number of geometries that are known to those in the packaging arts), so as to allow a user, upon pulling tab 56, to cleanly separate tear-strip 52 from first compartment 20 and flap 54 Flap 54 is intended for fixed attachment, preferably by means of an appropriate adhesive, to second compartment 30 during assembly of package 10

In a preferred embodiment, as described if FIG. 1, package 10 is formed from a blank that is fabricated from a suitable material The blank may be cut, punched or otherwise fashioned from any suitable material such as paper, paperboard, coated paperboard, cardboard, laminate material, polyvinyl chloride (PVC) or other plastic sheets, and the like The material is preferably relatively inexpensive and may be recyclable If paperboard is used, it may be solid bleach sulfate (SBS) paperboard which has good folding properties Indicia such as a product's brand name and graphics may be printed on the side of blank which will form the exterior of the package The surface of the paperboard which will form the exterior of the package may have a coating such as a white clay emulsion coating to facilitate printing thereon. The interior surface of the package may be uncoated or may be coated, sealed or otherwise treated to prevent contamination, flavor migration, spoilage or other undesirable changes to the consumable products stored in the package It may also be desirable to reinforce the corners or edges of the assembled package to provide more durability For example, additional material, glue or heat-activated material may be applied at the corners or edges to seal and otherwise provide the desired reinforcement.

In a preferred embodiment, package 10 is generally rectangular in shape and is sized to accommodate, for example, a single layer of pieces of gum contained in one or more blister packs It will be understood that the shape and size of package may be varied to accommodate different types, sizes and quantities of consumable products Preferably, as described in FIG. 1, package 10 includes a number of additional flap structures 60, 70 and side walls (63, 64, 72, 74) for providing the package with sufficient depth and stability for enclosing and protecting a consumable product, such as confectionaries 24, 34 contained in blister packages 22, 32 illustrated in FIG. 1 Flap 70 and side wall 72, as well as flap 60 and side wall 63, are preferably coupled via score lines, so as to facilitate folding during assembly of package 10. As previously mentioned with regard to flap 54, the specific geometries for package 10 are not limited to those depicted in FIG. 1, for instance, flap structures 60,70 need not have straight angled corners, but may, for example, be realized with rounded corners Package 10 preferably includes apertures 80, 82 which, upon assembly of and during use of package 10, allow a user greater ease in accessing the enclosed consumable product by grasping an edge of the packaged contents (e.g, blister packages 22, 32) Apertures 80, 82 are depicted in FIG. 1 as being approximately oval in shape, but it should be appreciated that alternative shapes may be employed Upon being fully assembled (as detailed further herein with reference to FIGS. 2-3) package 10 may, if desired, be enclosed in an outer wrapper or overwrapper such as a clear or opaque plastic film (not shown).

The gum or other product may be contained in any desired form, with or without additional packaging. For example, the product may be contained with additional packaging, which can be in the form of one or more blister packs, additional belly bands, or other wrapping forms Alternatively, in another embodiment, the packaging may not include any additional internal packaging for the gum or other products Throughout the Figures, chewing gum in the form of pellets in a blister package are shown in the package Alternate configurations and embodiments, as well as packaging and types of chewing gum, are considered and are deemed to be covered within the scope of this invention FIGS. 2-7 provide further illustrations regarding a preferred process for the assembly and partial disassembly of package 10

Figure 2:
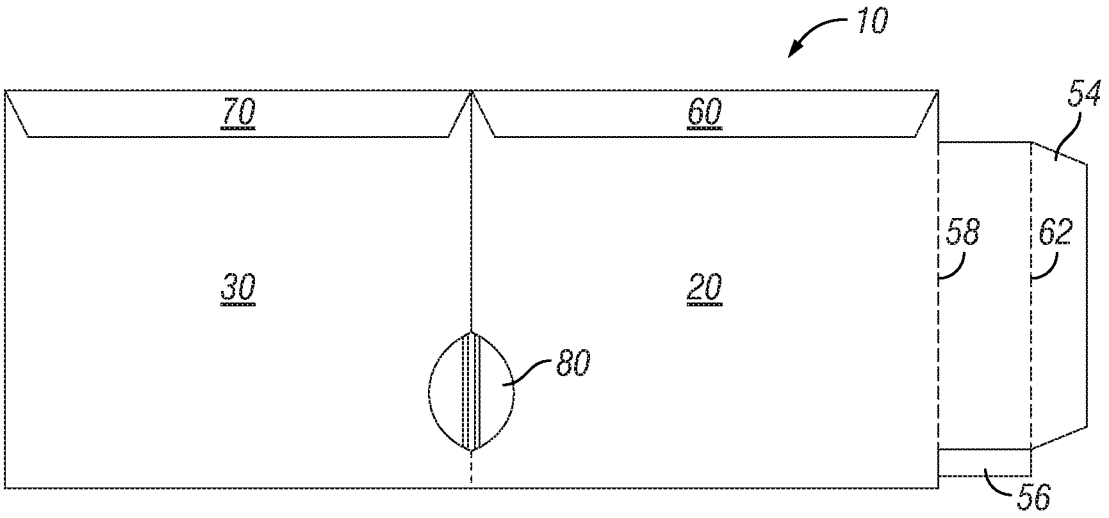
FIG. 2 depicts a partially assembled multi-compartment package for a consumable product, in accordance with a preferred embodiment of the present invention
Figure 3:
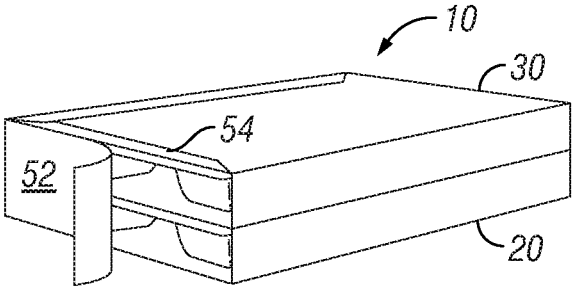
FIG. 3 depicts a first view of a partially disassembled multi-compartment package for a consumable product, wherein a tear-strip has been partially removed, in accordance with a preferred embodiment of the present invention
Figure 4:
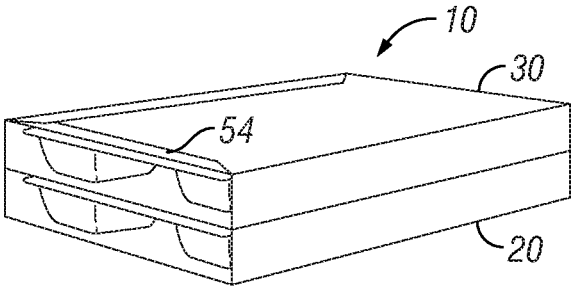
FIG. 4 depicts a second view of a partially disassembled multi-compartment package for a consumable product, wherein a tear-strip has been completely removed but wherein a first compartment and a second compartment have yet to be separated, in accordance with a preferred embodiment of the present invention

As depicted in FIG. 2, flaps 60, 70 are folded over and secured to respective compartments 20, 30, preferably by use of an appropriate adhesive Alternatively (not shown), flaps 60, 70 may be folded over and secured to an interior surface on back portions of compartments 20, 30 As depicted in FIG. 3, once compartments 20, 30 are formed, the second connection member that includes tear-strip 52 and tab 54 is folded over so that tab 54 contacts second compartment 30 Tab 54 is preferably secured to an outer surface of second compartment 30 by use of an appropriate adhesive Referring to FIGS. 3-4, once compartments 20, 30 are formed (as previously described), folded together, and secured, a user can separate the compartments by removing tear-strip 52 Tab 54 remains attached to second compartment 30

Figure 5:
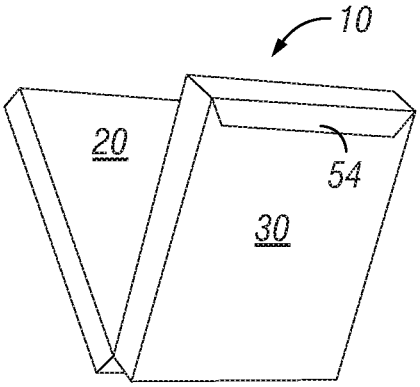
FIG. 5 depicts a third view of a partially disassembled multi-compartment package for a consumable product, wherein a first compartment and a second compartment are in the process of being hingedly detached, in accordance with a preferred embodiment of the present invention
Figure 6:
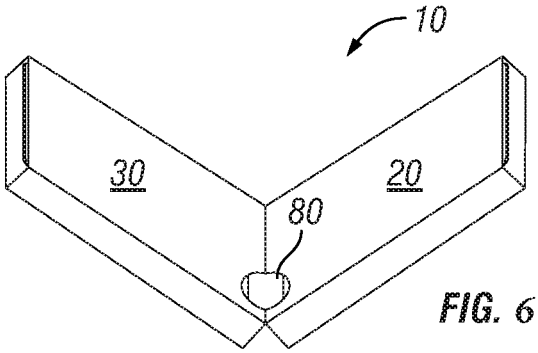
FIG. 6 depicts a fourth view of a partially disassembled multi-compartment package for a consumable product, wherein a first compartment and a second compartment are in the process of being separated and/or hingedly detached, in accordance with a preferred embodiment of the present invention
Figure 7:
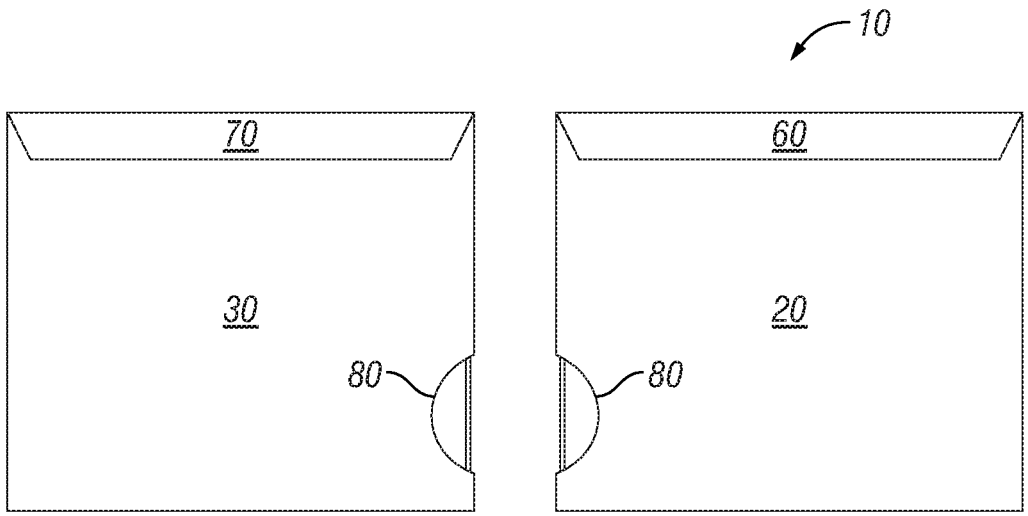
FIG. 7 depicts a fully disassembled multi-compartment package, wherein a first compartment and a second compartment have been detached, in accordance with a preferred embodiment of the present invention

Referring to FIGS. 5-7, with rear-strip 54 removed, compartments 20, 30 may be unfolded as illustrated Once compartments 20, 30 are at least partially unfolded, the two compartments may be separated by tearing of the perforation or score-line that forms hinge 40 (see FIG. 1).

It should be appreciated that, although the Figures and description primarily show the integration of two compartments to form the package, multiple compartments may be integrated to form the package as described by the invention. Moreover, multiple connection members (tear strips) may be provided by or integrated within the package for reinforce stability and to ensure that the compartments maintain their rigidity while at the same time enabling the consumer to break the connection member along a line of weakness, such as a perforation While the invention has been described with respect to certain preferred embodiments, as will be appreciated by those skilled in the art, it is to be understood that the invention is capable of numerous changes, modifications and rearrangements, and such changes, modifications and rearrangements are intended to be covered by the following claims.

What is claimed is:

1. A package for storing and dispensing a consumable product comprising:

a first compartment sized to receive a first quantity of consumable product;

a second compartment folded together with the first compartment and sized to receive a second quantity of consumable product;

a first connection member at a first end of the package comprising a hinge operatively coupled to each of the first compartment and the second compartment that facilitates manual detachment of the first compartment from the second compartment at the first connection member, wherein the first compartment and the second compartment are open at the first end of the package such that the first quantity and second quantity of consumable product is visible at the first end of the package; and a second connection member at a second end of the package coupling the first compartment to the second compartment while folded together, wherein the second connection member comprises at least one line of weakening that facilitates manual detachment of the first compartment from the second compartment at the second connection member, wherein detachment of the first compartment from the second compartment at the second connection member makes the first quantity and second quantity of consumable product visible at the second end of the package, and wherein separated first and second compartments enclose and protect consumable products contained therein.

2. The package of claim 1, wherein the second connection member comprises two lines of weakening.

3. The package of claim 1, wherein the first compartment comprises the first quantity of consumable product therein, wherein the second compartment comprises the second quantity of consumable product therein, and wherein the consumable product is a confectionery.

4. The package of claim 3, wherein the consumable product is chewing gum.

5. The package of claim 4, wherein the consumable product is a blister package of chewing gum.

6. The package of claim 2, wherein the second connection member is coupled to the first compartment at a first line of weakness, and to the second compartment at a second line of weakness, wherein each of the first line of weakness and the second line of weakness facilitates manual detachment of the first compartment from the second compartment at the second connection member.

7. The package of claim 6, wherein the second connection member comprises:

a tear-strip coupled to the first compartment at the first line of weakness; and a flap coupled to the tear-strip at the second line of weakness and the second compartment.

8. The package of claim 6, wherein at least one of the first and the second lines of weakness is formed by one of: (i) a perforated line; and (ii) a score line.

9. The package of claim 7, wherein at least one of the first and the second lines of weakness is formed by one of: (i) a perforated line; and (ii) a score line.

10. The package of claim 1, wherein the package is enclosed within an overwrap.

* * * * *